United States Patent [19]

Yoshikawa et al.

[11] 4,038,819

[45] Aug. 2, 1977

[54] THROTTLE OPENER

[75] Inventors: Eiji Yoshikawa; Tsuneo Kobayashi, both of Susono, Japan

[73] Assignee: Toyota Jidosha Kogyo Kabushiki Kaisha, Toyota, Japan

[21] Appl. No.: 536,599

[22] Filed: Dec. 26, 1974

[30] Foreign Application Priority Data

June 10, 1974 Japan ..... 49-65087

[51] Int. Cl.[2] ..... F02B 75/10

[52] U.S. Cl. ..... 60/307; 123/97 B; 123/103 E

[58] Field of Search ..... 60/307, 290; 123/97 B, 123/103 R, 103 C, 103 E

[56] References Cited

U.S. PATENT DOCUMENTS

| | | | |
|---|---|---|---|
| 2,517,501 | 8/1950 | Mennesson | 123/103 E |
| 3,250,261 | 5/1966 | Wiles | 123/103 R |
| 3,369,364 | 2/1968 | Ayers | 60/307 |
| 3,529,586 | 9/1970 | Fort | 123/103 R |
| 3,575,149 | 4/1971 | Graham | 123/103 R |
| 3,753,427 | 8/1973 | Cedar | 123/97 B |
| 3,775,971 | 12/1973 | Gadefelt | 60/280 |
| 3,796,049 | 3/1974 | Hayashi | 60/290 |

*Primary Examiner*—Douglas Hart

*Attorney, Agent, or Firm*—Stevens, Davis, Miller & Mosher

[57] ABSTRACT

A throttle opener comprises a diaphragm apparatus installed between a throttle valve provided within a throttle bore and an air pump for delivering air to an air injection device for controlling the opening of the throttle to enhance the burning of an air-fuel mixture, thereby decreasing the amount of unburned hydrocarbons in the exhaust gas. The diaphragm apparatus includes a diaphragm member movably fixed therein, responsive to the high delivery pressure from the air pump at the beginning of deceleration period of a vehicle to open the throttle valve slightly enough to prevent misfire of the mixture, thus decreasing the amount of unburned hydrocarbons in the exhaust gas.

3 Claims, 1 Drawing Figure

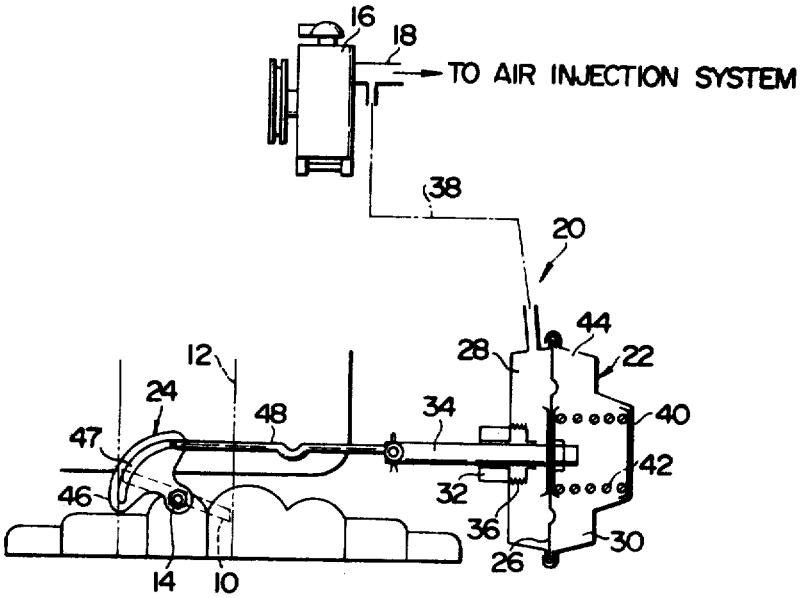
16
18
TO AIR INJECTION SYSTEM
38
20
44
22
28
12
24
48
34
40
47
42
46
32
36
30
26
14
10

THROTTLE OPENER

BACKGROUND OF THE INVENTION

The present invention relates to a throttle opener for use in controlling the opening of a throttle valve to provide the optimum condition for burning an air-fuel mixture, at a deceleration condition of a vehicle.

When a vehicle incorporating an engine with a carburetor is decelerated, the throttle value is returned to an idle position so that the intake efficiency of the engine is decreased due to the increased negative pressure in an intake maniford. In such a condition misfire is likely to take place thereby discharging a considerable amount of unburned hydrocarbons into the atmosphere. In order to meet recent regulations to control automobile air pollution, it has been proposed to install a throttle valve control such as a throttle positioner so arranged as to electrically detect vehicle speed, thereby actuating a solenoid valve to transmit intermittently the negative pressure in the intake manifold and atmospheric pressure to the actuating diaphragm, thus opening the throttle valve by such a predetermined value as to provide the maximum burning efficiency of fuel. The throttle, positioner, however, employs complex and expensive devices including a vehicle speed sensor, a computer, and a vacuum switching solenoid and a diaphragm so as to electrically detect the vehicle speed and control the throttle valve of the vehicle.

SUMMARY OF THE INVENTION

It is an object of the invention to provide a throttle opener composed of only mechanical elements, which is simple in structure and low cost in production.

Another object of the invention is to provide a throttle opener which prevents misfire from taking place when a vehicle having an engine with an air pump for air injection is decelerated, so as to decrease the amount of unburned hydrocarbons in the exhaust gas.

According to one aspect of the invention, there is provided a throttle opener for use in controlling the opening of a throttle valve of a vehicle having an air injection device to enhance the burning of an air-gasoline mixture characterized by a control system installed between an air pump for delivering air to the air injection nozzle and the throttle valve provided within a throttle bore, responsive to the delivery pressure from the air pump to control the opening of the throttle valve.

In accordance with another aspect of the invention there is provided a throttle opener for use in controlling the opening of a throttle valve of a vehicle having an air injection device to enhance the burning of an air-fuel mixture characterized by an air pump for delivering air to an air injection nozzle; a diaphragm apparatus including a diaphragm member movable responsive to the delivery pressure of the air pump; a shaft member forced to move by the movement of the diaphragm member; a linkage with one end connected to the shaft member and the other end provided with a guide pin member; an arm member having a groove or slot in the form of a circular arc therein for guiding the guide pin member; and means for fixing the arm member to the throttle valve.

Most of the existing engines have an air injection device for promoting the burning reaction within the exhaust system. The air injection system includes an air pump for delivering air to the system. The delivery pressure from the air pump is substantially proportional to engine speed or load. A throttle opener according to the present invention utilizes this delivery pressure from the air pump. According to the present invention, there is provided between the outlet of the air pump and the throttle valve a control system such as a diaphragm apparatus, the diaphragm of which is moved responsive to the delivery pressure from the air pump to turn the throttle valve clockwise via a throttle-actuating mechanism, thus providing the optimum condition for burning of fuel.

BRIEF DESCRIPTION OF THE DRAWINGS

Further objects and features of the present invention will now be described with reference being made to the attached drawings in which:

The FIGURE is a schematic diagram of a throttle opener embodying the invention.

DETAILED DESCRIPTION OF THE PREFERRED EMBODIMENTS:

A throttle valve 10 is rotatably secured to a throttle bore 12 by a throttle shaft 14 in a conventional manner. An air pump 16 has an outlet port or injection pipe leading to an air injection system (not shown). There is provided between the outlet port 18 and the throttle valve 10 a control system generally denoted by numeral 20 which includes a diaphragm apparatus 22 and the throttle valve actuating mechanism 24. The diaphragm apparatus 22 has a diaphragm member 26 which divides the casing of the diaphragm apparatus into two chambers 28 and 30. One chamber 28 is provided with a bearing member 32 which slidably supports a shaft 34, one end of which is bolted to the central portion of the diaphragm member 26. A bellows member 36 is fixed within the chamber 28 around the opening of the bearing member 32, making the chamber airtight. The chamber 28 is also connected to the outlet 18 via a tube 38. The other chamber 30 forms an actuator section 40 in which a spring member 42 is provided to bias the diaphragm member 26 to the non-actuated position, as shown in the FIGURE. The chamber 30 is maintained at the atmospheric pressure through a bleed hole 44.

The throttle valve actuating mechanism 24 consists of an arm member 46 secured to the throttle shaft 14, a groove or slot in the form of a circular arc 47 cut in the arm member 46 and a link member 48 provided at its one end with a guide pin adapt to move along the groove 47 and hinged at the other end to the end of the shaft 34 farther from the diaphragm member 26.

The operation of the throttle opener as described above will now be described. In the beginning of the deceleration period of a vehicle, the engine of the vehicle still rotates at a fairly high speed so that the delivery pressure from the air pump is considerable high. This high delivery pressure introduced into the chamber 28 pushes the diaphragm member 26 to the right as shown in the FIGURE, moving the shaft 34 and the link member 48 to the right, which pulls the arm member 46 to the right, thereby turning the throttle shaft 14 clockwise. The throttle valve 10 which is secured to the throttle shaft 14 is thus opened slightly enough to provide the optimum condition for fuel burning.

Towards the end of the deceleration period, the delivery pressure from the air pump 16 is decreased so that the diaphragm member 26 returns to the non-actuated position by the action of the spring member 42 provided within the chamber 30, thereby permitting the throttle valve 10 to return to the normal idling position.

Although the delivery pressure from the air pump 16 exceeds the preset value of the spring member 42 at the acceleration or high speed driving, forcing the diaphragm member 26 and link member 48 to move to the right against the bias of the spring member, the throttle valve 10 itself is opened by the operation of an acceleration pedal wider than the length of movement of the link member 48 to the right so that it can work out in a conventional way.

The advantages of the throttle opener as illustrated above are as follows:

1. The amount of unburned hydrocarbons in the exhaust gas is effectively reduced since misfire is prevented due to the fact that the throttle valve 10 is kept slightly open by the throttle opener of the invention until a vehicle nearly stops;

2. High reliability is attained since a small number of simple mechanical components are required to make up the throttle opener of the invention; and 3. The cost of production is reduced with the throttle opener of the invention since expensive devices such as an electrical control are removed.

What is claimed is:

1. A throttle opener for use in controlling the opening of a throttle valve of a vehicle engine having an air injection device to enhance the burning of an air-fuel mixture, comprising: an air pump for delivering air to the air injection device; a diaphragm apparatus including a diaphragm member movable in response to the delivery pressure from said air pump to maintain the opening of the throttle valve soon after deceleration of the vehicle and reduce the opening to an idling opening in accordance with the vehicle speed; said diaphragm apparatus including a casing which is divided into a first chamber and a second chamber by said diaphragm member, said first chamber being provided with a bearing member having an opening, and a bellows member around the opening of said bearing member within said first chamber for making it airtight; a shaft member forced to move by movement of said diaphragm member; a link member connected at one end to said shaft member and provided at the other end with a guide pin member; an arm member having a groove or slot in the form of a circular arc therein for guiding said guide pin member; and means for fixing said arm member to said throttle valve.

2. A throttle opener as defined in claim 1 wherein said diaphragm apparatus includes a spring member provided between said diaphragm member and a wall of said second chamber of said casing for returning said diaphragm member to a non-actuated position against the delivery pressure from said air pump.

3. A throttle opener as defined in claim 2 wherein said diaphragm apparatus includes a bleed hole provided on a wall of said second chamber of said casing for keeping said second chamber at atmospheric pressure.

* * * * *